United States Patent [19]

Summerlin

[11] Patent Number: 4,566,411

[45] Date of Patent: Jan. 28, 1986

[54] SPLIT CYCLE ENGINE

[76] Inventor: Frederick A. Summerlin, "The Spinney", Rose La., Wheathampstead, St. Albans, Hertfordshire, England

[21] Appl. No.: 475,178

[22] Filed: Mar. 14, 1983

[30] Foreign Application Priority Data

Apr. 2, 1982 [GB] United Kingdom ..... 8209934

[51] Int. Cl.[4] ..... F02B 53/08

[52] U.S. Cl. ..... 123/213; 123/215; 123/234

[58] Field of Search ..... 123/236, 237, 238, 234, 123/235, 68, 213, 215, 204; 60/39.63; 418/54, 61 A

[56] References Cited

U.S. PATENT DOCUMENTS

| | | | |
|---|---|---|---|
| 2,102,946 | 12/1937 | Dugelay | 123/68 |
| 2,239,922 | 4/1941 | Martinka | 123/68 |
| 3,688,749 | 9/1972 | Wankel | 123/213 |
| 3,858,557 | 1/1975 | Myers et al. | 123/213 |
| 3,989,011 | 11/1976 | Takahashi | 123/213 |
| 4,126,200 | 11/1978 | Miller et al. | 74/751 |
| 4,253,805 | 3/1981 | Steinwart et al. | 418/54 |

*Primary Examiner*—Michael Koczo
*Assistant Examiner*—John J. McGlew, Jr.
*Attorney, Agent, or Firm*—Oblon, Fisher, Spivak, McClelland & Maier

[57] ABSTRACT

The improved split cycle engine comprises a compression unit 1 mechanically connected to an expansion unit 3 via shaft 2 and to a load via a coupling or centrifugal clutch 5, and a second compression unit 7 which is mechanically connected by shaft 9 to a second expansion unit 8. Compression unit 1 is fed by compression unit 7 and its output is fed to expansion unit 3 via a variable cut-off valve. Fuel is burnt in the air supplied by compression unit 1. The exhaust of expansion unit 3 feeds expansion unit 8. At high cut-off ratios shaft 9 rotates many times faster than shaft 2 and its relative speed is reduced as the cut-off ratio is decreased. At high cut-off ratios the torque output is substantially higher than that of a conventional internal combustion engine so that a complicated transmission is not necessary.

2 Claims, 9 Drawing Figures

SPLIT CYCLE ENGINE

This invention relates to split cycle engines, i.e., engines in which the working fluid is compressed in a compression unit and then fed via a transfer passage to an expansion unit, heat being supplied to the fluid while the latter is in either the transfer passage or the working space of the expansion unit.

The heat supplied to the working fluid may be from an outside source, but preferably is produced by combustion of fuel in the transfer passage or expansion unit working space. In this case the compression unit preferably supplies air to the transfer passage and fuel is injected into either the transfer passage or the working space of the expansion unit. Ignition of the fuel may be effected by the increased temperature of the air charge due to its compression or by other means such as an electrically heated glow plug.

Such a split cycle is widely used in gas turbines but it is also known to use positive displacement devices for both the compression and expansion units.

The compression and expansion units may comprise reciprocating piston and cylinder assemblies or may operate in a substantially rotary manner.

U.K. Pats. Nos. 1,120,248, 1,190,948 and U.K. application No. 2,019,499 disclose reciprocating split cycle engines and U.S. Pat. No. 4,245,597 discloses a rotary arrangement. U.S. Pat. No. 4,253,805 discloses a compression unit which is suited to use in a split cycle engine. Expansion units can be constructed in a similar manner to this compression unit by those skilled in the art.

In split cycle engines it is usual for the working fluid to be admitted to the expansion unit for a limited angular rotation of the output shaft. The "cut-off" ratio is then defined as the ratio of the expansion unit volume at the time the admission means closes to the maximum volume of the expansion unit.

According to one aspect of the invention there is provided a split cycle engine adapted to drive a load, which engine comprises, in combination;

first and second positive displacement compression units for compressing working fluid therein;

first and second positive displacement expansion units, adapted to be driven by the expansion of working fluid therein;

the first expansion unit having a variable cut-off ratio;

a transfer passage connected between the first compression unit and the first expansion unit for transferring working fluid which has been compressed by the first compression unit to the first expansion unit to drive the first expansion unit by expanding therein;

variable heat-supply means for supplying heat at a variable rate to the working fluid in the transfer passage or the first expansion unit;

a first driving connection drivingly connecting the first expansion unit to drive the first compression unit, the first driving connection also being effective to drive the aforesaid load;

a first working fluid connection connected between the first expansion unit and the second expansion unit to deliver working fluid which has been expanded in the first expansion unit to the second expansion unit to drive the second expansion unit by further expanding therein;

a working fluid exhaust connected to the second expansion unit for the outlet of working fluid which has been expanded therein;

a second driving connection drivingly connecting the second expansion unit to drive the second compression unit;

a working fluid inlet connected to the second compression unit for supplying working fluid thereto;

a second working fluid connection connected between the second compression unit and the first compression unit to deliver working fluid which has been compressed by the second compression unit to the first compression unit to be further compressed thereby; and cut-off ratio varying means associated with the first expansion unit for varying the cut-off ratio of the first expansion unit.

Preferably the engine further comprises interconnecting means which interconnects the cut-off ratio varying means and the variable heat-supply means and is effective to maintain a predetermined relationship between the cut-off ratio of the first expansion unit and the rate of heat supply to the working fluid.

An embodiment of the invention in the form of a split cycle engine will now be described by way of example with reference to the accompanying drawings in which.

Figure 1:
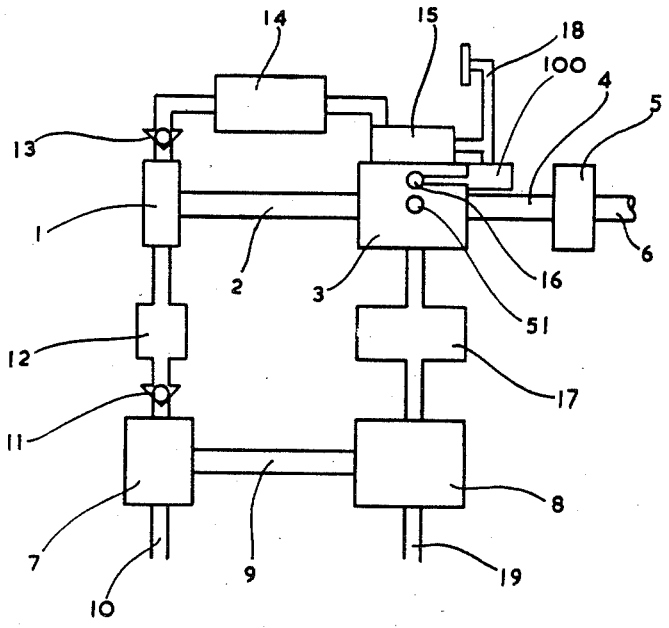
FIG. 1 is a block diagram showing the elements of the engine.

Referring to FIG. 1, the first compression unit 1 is connected by a shaft 2 to a first expansion unit 3. An extension 4 of shaft 2 connects to the load through a transmission unit 5 which may comprise a centrifugal clutch, hydraulic coupling, hydraulic torque converter or other device which permits the speed of input shaft 4 to the transmission unit 5 to be different to the speed of the transmission unit via output shaft 6.

A second compression unit 7 is driven by a second expansion unit 8 via shaft 9 which drivingly connects the second compression and expansion units. The second compression unit takes atmospheric air via inlet 10 and after compression to an intermediate pressure, delivery is effected via discharge non-return valve 11 to the reservoir 12. First compression unit 1 takes it input at intermediate pressure from reservoir 12 and discharges via non-return valve 13 to the transfer passage 14.

Transfer passage 14 is connected via variable cut-off valve 15 to expansion unit 3. Variable cut-off valve 15 is controlled by operation of an accelerator pedal 18 which also acts to vary the quantity of fuel supplied via injector 16 to the working space of expansion unit 3 as an appropriate function of cut-off ratio to maintain substantially constant pressure in transfer passage 14. Ignition of the fuel supplied by injector 16 is effected by means of glow plug 51. Transfer passage 14 is of sufficient volume so that when the cut-off ratio is changed rapidly the change in pressure of transfer passage 14 before compression unit 7 and expansion unit 8 reach a new stable speed is minimised.

Reservoir 12 is of sufficient volume to minimise pressure fluctuations due to the fluctuating delivery from compression unit 7 and the fluctuating input of compression unit 1, but not so large as to excessively delay changes in pressure due to changes in cut-off ratio.

After expansion in expansion unit 3 the working fluid is exhausted to reservoir 17 from which it passes to the second expansion unit 8. Reservoir 17 is of sufficient volume to minimise pressure fluctuatings due to the fluctuating exhaust from expansion unit 3 and fluctuating input to expansion unit 8, but not so large as to excessively delay changes in pressure due to changes in cut-off ratio. The exhaust from expansion unit 8 passes to atmosphere via passage 19.

The supply of fuel is programmed as a function of cut-off ratio to keep the pressure in transfer passage 14 substantially constant. The fuel is supplied via injector 16 to expansion unit 3 during the period when the cut-off valve 15 is open. The capacity of the transfer passage assists in the maintenance of constant pressure combustion. When accelerator pedal 18 is operated the proportion of the swept volume of expansion unit 3 during which working fluid is admitted from transfer passage 14 increases, as does the quantity of fuel admitted via injector 16.

Thus there is a substantial increase in the mean effective pressure of expansion unit 3 and a consequent increase in torque output.

Assuming that the speed of compression unit 1 and expansion unit 3 remains constant, the increase in cut-off ratio of expansion unit 3 necessitates an increase in the quantity of working fluid supplied by compression unit 1. However the quantity of working fluid discharged by expansion unit 3 to reservoir 17 is increased by the increase in cut-off ratio of expansion unit 3. Hence the pressure in reservoir 17 is increased, resulting in an increase in torque output from expansion unit 8. Expansion unit 8 drives compression unit 7 only, and hence under steady state conditions the torque and power output of expansion unit 8 must equal the torque and power input to compression unit 7. The effect of the increase in pressure in reservoir 17 is therefore to increase the speed of shaft 9. Increasing speed of shaft 9 will result in more working fluid being drawn by expansion unit 8 from reservoir 17 hence the pressure in reservoir 17 will tend to reduce. The increase in speed of shaft 9 will also result in more atmospheric air being compressed by compression unit 7 and delivered to reservoir 12, resulting in an increase of pressure in reservoir 12 and an increase in the power required to drive compression unit 7. The increase in pressure in reservoir 12 results in an increase in the quantity of working fluid delivered by compression unit 1 to expansion unit 3.

Thus assuming there is no change in the speed of shaft 2, the effect of increasing the cut-off ratio of expansion unit 3 is to produce an increase in the pressure of reservoir 17, an increase in speed of shaft 9, an increase in pressure of reservoir 12, an increase in the quantity of working fluid supplied by compression unit 1 to expansion unit 3 and an increase in the torque and power output of expansion unit 3, these changes resulting in a new stable operating condition being established in the system.

A further effect of increasing the cut-off ratio is to increase the pressure at the end of the working stroke of the first expansion unit 3 since the working fluid is expanded over a smaller ratio. In the extreme case when the cut-off ratio is equal to, or greater than unity, the pressure at the end of the working stroke equals the inlet pressure. Although pressure in reservoir 17 also rises, the difference between the pressure at the end of the working stroke of expansion unit 3 and the pressure in reservoir 17 increases. Thus work done against the pressure of reservoir 17 during the exhaust stroke of expansion unit 3 will be small and the net work done per stroke will be large giving a high torque output.

Expansion unit 8 which is supplied from reservoir 17 preferably has a fixed cut-off ratio of unity. This does not substantially reduce the overall efficiency of the engine but substantially reduces the complexity of expansion unit 8.

Figure 2:
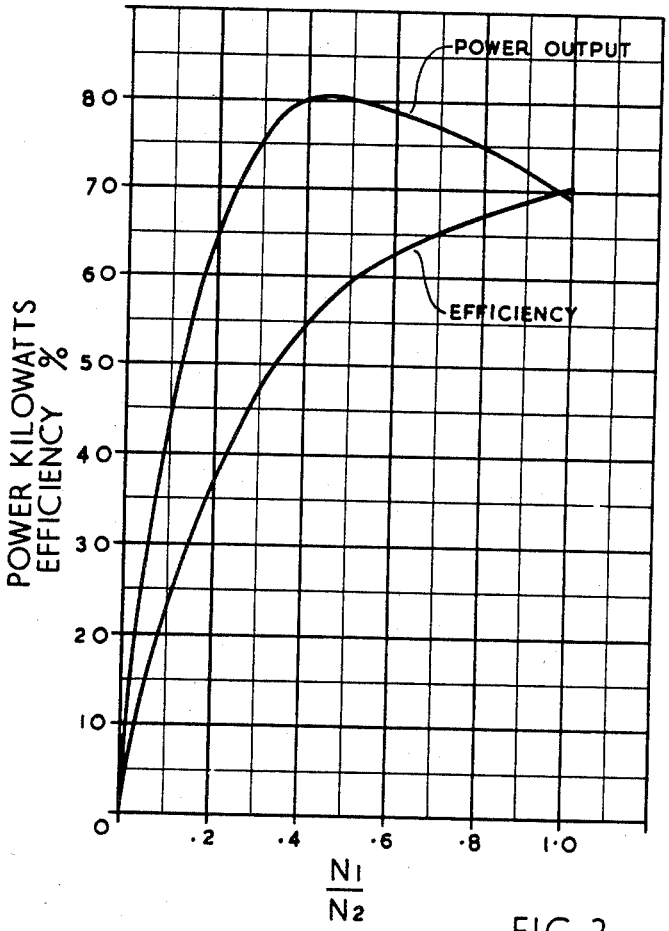
FIG. 2 is a curve showing the calculated overall performance of the engine.
Figure 3:
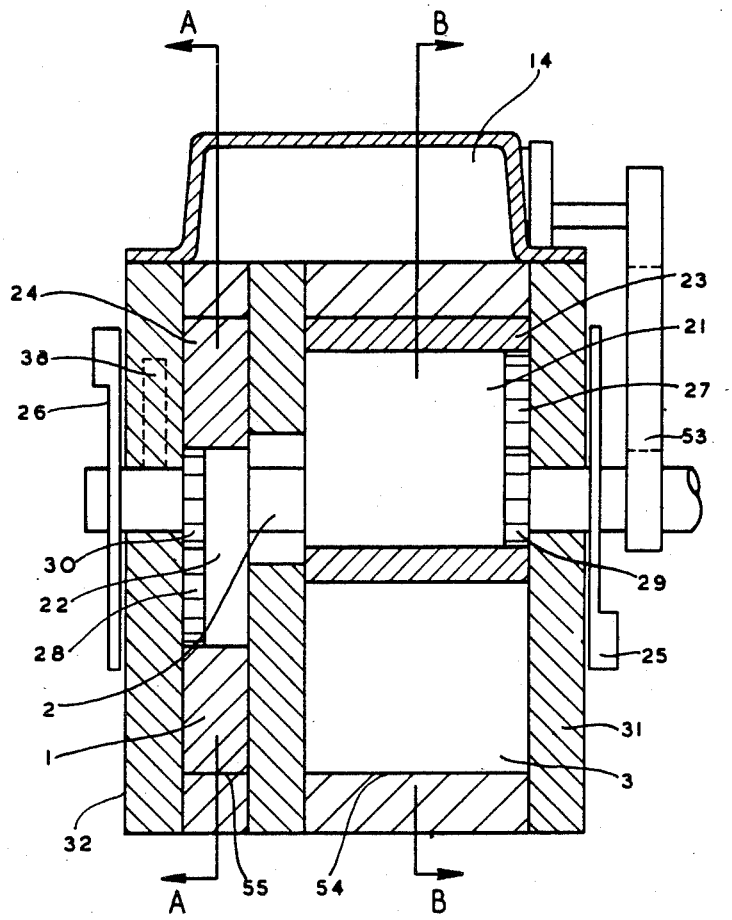
FIG. 3 is a section through an assembly comprising the first compression unit and first expansion unit.

The characteristics of the system can be calculated, and typical results are given in FIG. 2. Here it is assumed that the swept volume per revolution of shaft 2 is 0.35 liters for compression unit 1 and one liter for expansion unit 3. It is also assumed that the swept volume per revolution of shaft 9 for compression unit 7 is 0.7 liter and for expansion unit 8 is one liter. In the calculations the cut-off ratio of the second expansion unit 8 is assumed to be unity, i.e. a full working space is supplied from reservoir 17 during each cycle. It is also assumed that the pressure in transfer passage 14 is maintained constant at a value of 4476 Kilo Newtons per square meter.

The calculated power output is on an indicated basis, i.e, friction and other losses have been neglected. The efficiency is calculated as the power output divided by the work equivalent of the heat input.

FIG. 2 shows full load power output to a base of $N_1/N_2$ where $N_1$ is the speed of shaft 2 and $N_2$ is the speed of shaft 9. It has been assumed that at full load $N_2$ is constant at 6000 rpm. At part load $N_2$ will be reduced and the power output curve will be similar but reduced by the factor $N_2/6000$. The calculated efficiency of the engine is also plotted. This is not dependent of the absolute value of $N_2$ only on the ratio $N_1/N_2$.

The power output of the engine is remarkably constant as $N_1$ the speed of the output shaft changes. Thus at $N_1/N_2$ equals 0.1 the power output is 45 Kilowatts rising to a peak of 80 Kilowatts when $N_1/N_2$ equals 0.45 before falling away to 70 Kilowatts when $N_1/N_2$ equals unity. We must compare this with the characteristic of a conventional engine where the power output is substantially proportional to output shaft speed up to the speed at which power output is at maximum.

That is if we assume the maximum power of the conventional engine is 80 Kilowatts at 6000 rpm the power at 600 R.P.M. (equivalent to when $N_1/N_2$ equals 0.1) would be 8 Kilowatts.

Thus the power output has been increased over the conventional engine by a factor of approximately 5.5 times at 600 R.P.M.

A typical construction of the engine will now be described with reference to FIGS. 3–9.

Referring first to FIGS. 3, 4, 5 and 6, which show the arrangement of the first compression unit 1 and the first expansion unit 3. In this arrangement the first compression unit 1, discharge non-return valve 13, transfer passage 14, variable cut-off valve 15, injector 16, glow plug 51 and first expansion unit 3 are all provided in a common housing. Shaft 2 carries eccentrics 21 and 22 which are in antiphase relationship, and respectively drive the rotor 23 of the first expansion unit 3 and the rotor 24 of the first compression unit 1.

Extensions of shaft 2 carry balance weights 25 and 26 which also serve as flywheels. Rotors 23 and 24 are constrained to rotate at one half the speed of shaft 2 by gears 29 and 30 which are mounted on the end plates 31 and 32 respectively concentric with shaft 2 and meshing gears 27 and 28 mounted in the bore of rotors 23 and 24 respectively. Gears 29 and 30 carry one half the number of teeth on gears 27 and 28.

Rotors 23 and 24 respectively co-operate with the single lobe epitrochoidal housings 54 and 55 so as to divide each epitrochoidal housing into two chambers. This construction is similar to that described in U.S. Pat. No. 4,253,805.

Figure 4:
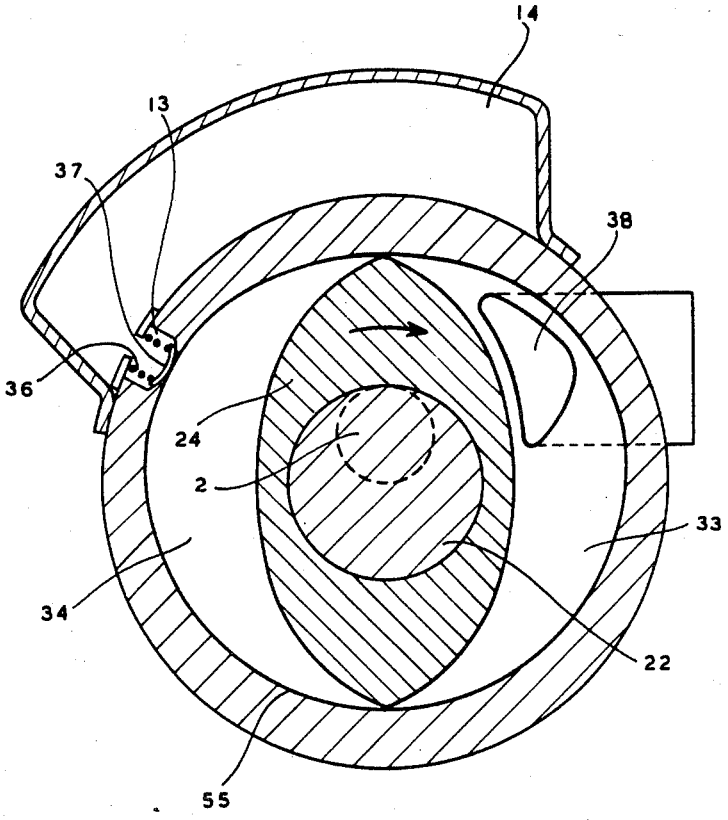
FIG. 4 is a section along the line A—A of FIG. 3 showing the arrangement of the inlet port and discharge non-return valve of the first compression unit.

In FIG. 4 chambers 33 and 34 are of equal volumes and as rotation of shaft 2 continues chamber 34 reduces in volume and chamber 33 increases in volume. Discharge non-return valve 13 comprising spring 36 and valve disc 37 connects chamber 34 to transfer passage 14 and inlet port 38 connects chamber 33 with reservoir 12 of FIG. 1.

Figure 5:
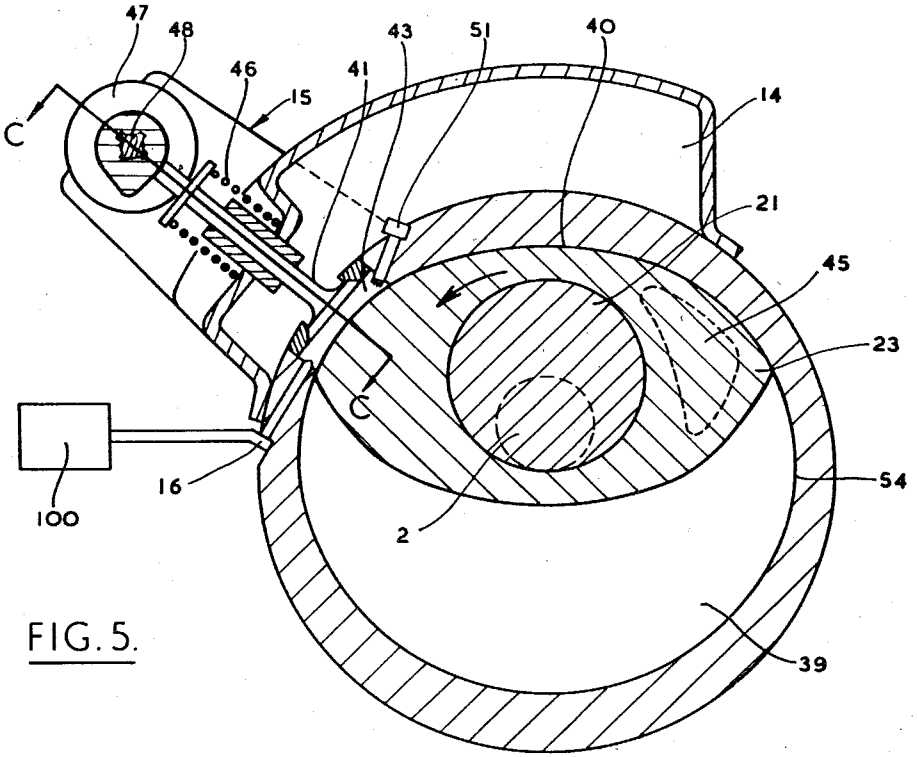
FIG. 5 is a section along the line B—B of FIG. 3 showing the arrangement of the variable cut-off inlet valve and the exhaust port of the first expansion unit.

In FIG. 5 chamber 39 is at maximum volume and chamber 40 at minimum volume. The valve member 41 of the variable ratio cut-off valve 15 is just about to open and admit working fluid from the transfer passage 14 to chamber 40. Fuel injection nozzle 16 is arranged to supply fuel to clearance volume 43 under the cut-off valve. Chamber 39 contains working fluid after expansion and as shaft 2 rotate is about to discharge through exhaust port 45 to reservoir 17 of FIG. 1.

Figure 6:
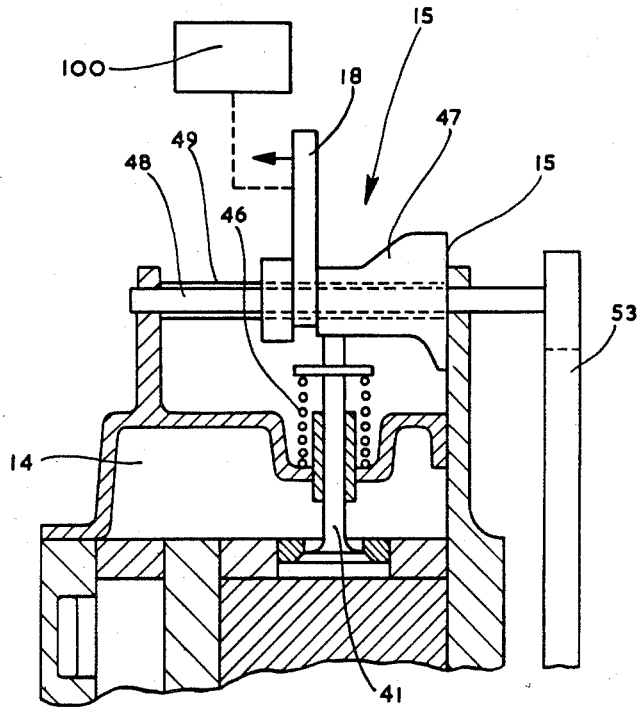
FIG. 6 is a part section along the line C—C of FIG. 5 showing the arrangement of the variable cut-off inlet valve.

As shown in FIGS. 5 and 6 variable ratio cut-off valve 15 comprises a valve member 41 urged against its seat by spring 46 and is opened by cam 47. Cam 47 is driven by shaft 48 by means of splines 49 so that it can be moved axially by accelerator lever 18. Shaft 48 is driven at the same speed as shaft 2 by means of the toothed belt 53.

The profile of cam 47 varies along its length so as to open valve member 41 at a fixed angle but to delay the closing of valve member 41 progressively. Thus accelerator lever 18 engages with cam 47 so that cam 47 can be moved axially and provide adjustment of the cut-off ratio.

There is also provided a similar variable cam device 100 also operated by lever 18, which controls the quantity of fuel supplied to expansion unit 3 so as to maintain substantially constant pressure in transfer passage 14.

Figure 7:
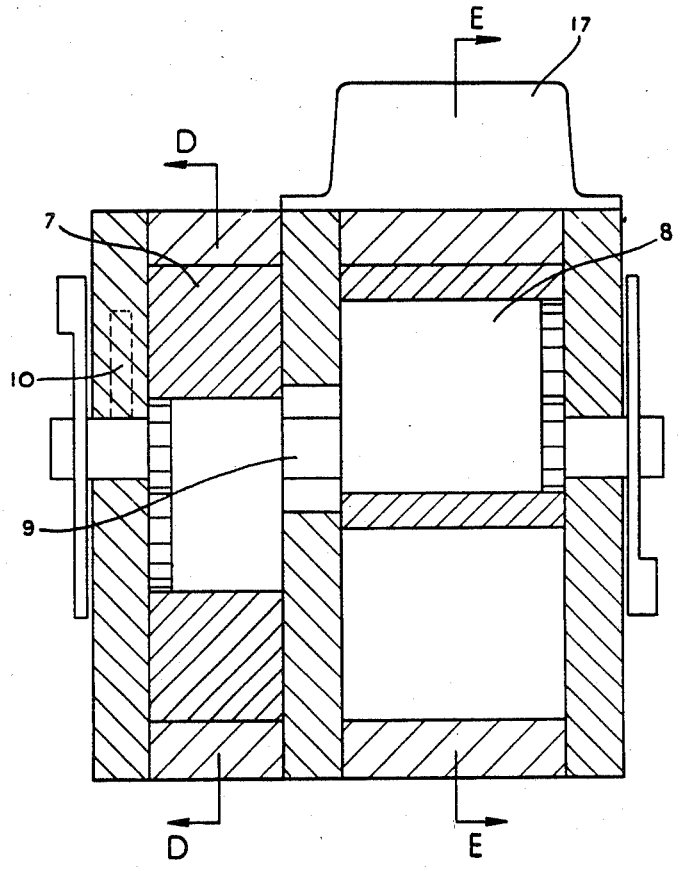
FIG. 7 is a section through an assembly comprising the second compression unit and second expansion unit.
Figure 8:
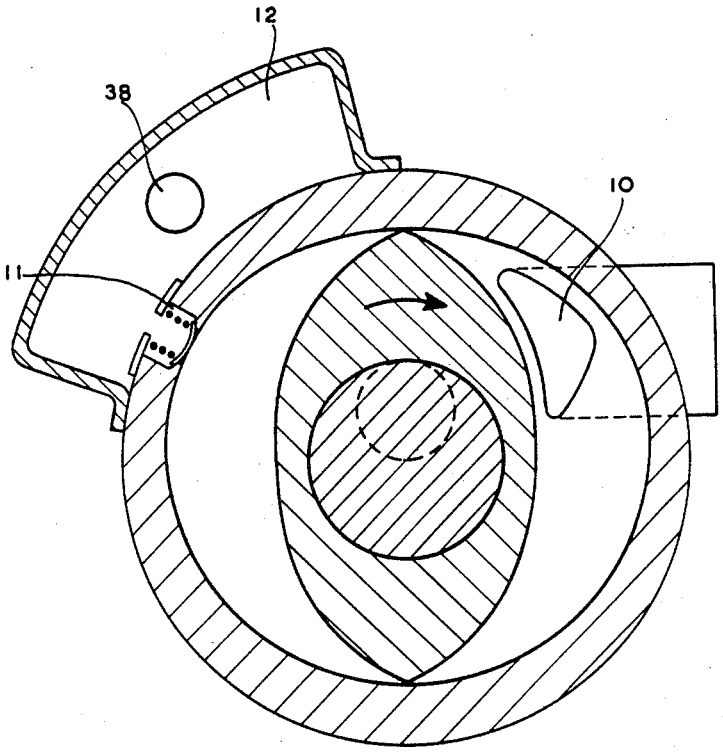
FIG. 8 is a section along the line D—D of FIG. 7 showing the arrangement of the inlet port and discharge non-return valve of the second compression unit.
Figure 9:
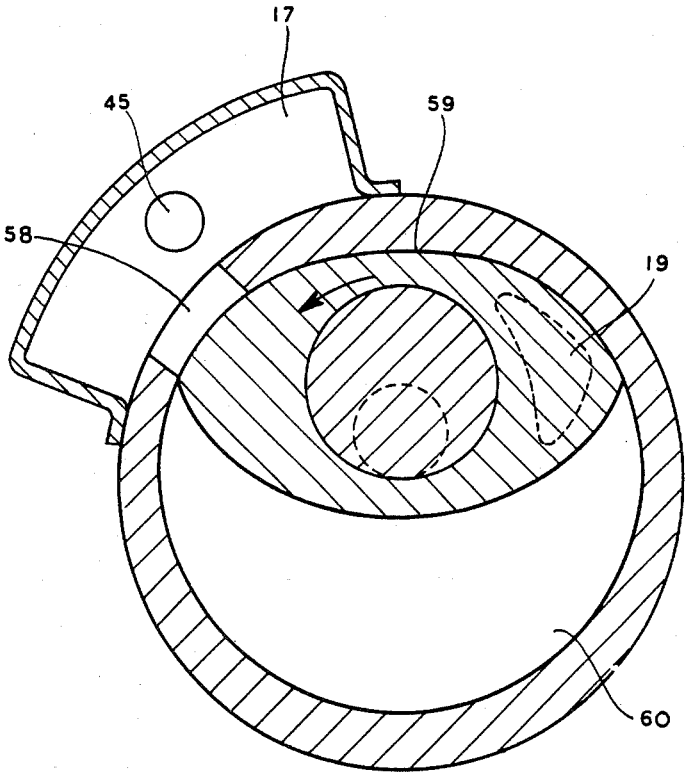
FIG. 9 is a section along the line E—E of FIG. 7 showing the arrangement of the exhaust and inlet ports of the second compression unit.

The assembly of the second expansion unit 8 and second compression unit 7 is shown in FIGS. 7, 8 and 9. The construction of the compression unit 7 is similar to that of the first compression unit 3 but in this case inlet port 10 is connected to atmosphere and outlet non-return valve 11 connects to the reservoir 12 of FIG. 1.

The construction of the second expansion unit 8 is also similar to the first expansion unit 3 except that a simple radial port 58 alternately connects one of the working spaces 59 and 60 to the reservoir 17 of FIG. 1 and exhaust port 19 connects the other of the working spaces 59 and 60 to atmosphere.

The operation of the first compression unit 1 and first expansion unit 3 will now be described.

Referring to FIG. 4 Rotor 24 is moving in the direction of the arrow. Chamber 34 is reducing in volume and when the pressure reaches that of the transfer passage 14 discharge non-return valve 13 opens and the compressed charge is transferred to the passage 14. Meanwhile chamber 33 is increasing in volume and a fresh charge is being admitted via port 38 from reservoir 12 of FIG. 1. Thus for each revolution of shaft 2 a full working space (either 34 or 33) of fresh charge is discharged to transfer passage 14 and the other working space (33 or 34) receives a charge from reservoir 12 ready for discharge to passage 14 on the next revolution of shaft 2.

The discharge non-return valve 13 and inlet port 38 are positioned so that the apex of rotor 24 traverses the discharge valve port at a time in the cycle where the effects of temporarily connecting chambers 33 and 34 are negligible.

Operation of the first expansion unit 3 will now be described with reference to FIG. 5.

Rotor 23 is moving in the direction of the arrow. Variable cut-off valve 15 is just about to open and supply working fluid from transfer passage 14 to working space 40 which is increasing in volume. Working space 39 is reducing in volume and after rotor 23 has rotated a few degrees exhaust port 45 is opened. The spent charge in space 39 expands into reservoir 17 of FIG. 1 and remaining exhaust gases in space 39 are swept out as space 39 further reduces in volume.

Meanwhile when the volume of working space 40 has increased sufficiently cut-off valve 15 closes and the charge in space 40 expands until the volume of space 40 is maximum when port 45 is uncovered and the exhaust cycle is commenced. At this stage space 39 is at near minimum and cut-off valve 15 has just opened to commence another cycle.

Operation of the assembly of the second compression unit and second expansion unit will now be described with reference to FIGS. 8 and 9.

FIG. 8 shows a cross section of the second compression unit. Operation of this unit is identical to that of the first compression unit except that the output non-return valve 11 discharges into reservoir 12 and the inlet port 10 connects to atmosphere.

Operation of the second expansion unit shown in FIG. 9 is similar to that of the first expansion unit except that the fresh charge is admitted through port 58 which is open for substantially the full period when working space 59 is increasing in volume. When the volume of the working space is at a maximum as shown for space 60 exhaust port 19 opens and as the working space reduces in volume the exhaust cycle takes place.

Advantages of the split cycle engine described in the foregoing example are that it is capable of providing a substantially constant power output over a wide range of output shaft speed, i.e. substantially increased torque at lower output shaft speeds. It is therefore particularly suited to vehicle applications since requirements for a variable ratio transmission are significantly reduced.

Additionally the engine is remarkably compact. For example a swept volume per revolution of one liter can be obtained using an epitrochoidal chamber of major diameter 150 mm and a length of 100 mm.

The invention is not restricted to the details of the foregoing example.

The cut-off ratio can be varied by means of valve gear linkage mechanisms of the type which have been used extensively in reciprocating steam engines and are described in any standard text, e.g. Stephenson's link motion; Walschaert's valve gear; Joy's valve gear or Hackworth's valve gear; or by the cam method described in U.K. Pat. No. 1,190,948.

I claim:

1. A split cycle engine adapted to drive a load, which engine comprises, in combination:

first and second positive displacement compression units for compressing working fluid therein;

first and second positive displacement expansion units, adapted to be driven by the expansion of working fluid therein;

the first expansion unit having a variable cut-off ratio;

a transfer passage connected between the first compression unit and the first expansion unit for transferring working fluid which has been compressed by the first compression unit to the first expansion unit to drive the first expansion unit by expanding therein;

variable heat-supply means for supplying heat at a variable rate to the working fluid in one of the transfer passage and the first expansion unit;

a first driving connection connecting the first expansion unit to the first compression unit for driving the first compression unit from the first expansion unit, the first driving connection also being effective to drive the aforesaid load;

a first working fluid connection connected between the first expansion unit and the second expansion unit to deliver working fluid which has been expanded in the first expansion unit to the second expansion unit to drive the second expansion unit by further expanding therein;

a working fluid exhaust connected to the second expansion unit for the outlet of working fluid which has been expanded therein;

a second driving connection drivingly decoupled from said first driving connection and from said load and, connecting the second expansion unit to the second compression unit for driving the second compression unit from the second expansion unit;

a working fluid inlet connected to the second compression unit for supplying work fluid thereto;

a second working fluid connection between the second compression unit and the first compression unit to deliver working fluid which has been compressed by the second compression unit to the first compression unit to be further compressed thereby; and cut-off ratio varying means associated with the first expansion unit for varying the cut-off ratio of the first expansion unit.

2. A split cycle engine as claimed in claim 1, further comprising:

interconnecting means which interconnects the cut-off ratio varying means and the variable heat-supply means and is effective to maintain a predetermined relationship between the cut-off ratio of the first expansion unit and the rate of heat supply to the working fluid.

* * * * *